United States Patent [19]

McQuiston

[11] 4,214,669

[45] Jul. 29, 1980

[54] CARGO CONTAINER

[76] Inventor: William W. McQuiston, 1664 Shattuck Ave., Berkeley, Calif. 94709

[21] Appl. No.: 3,406

[22] Filed: Jan. 15, 1979

[51] Int. Cl.[2] ..... B65D 7/26; B65J 1/02

[52] U.S. Cl. ..... 220/6; 220/1.5; 220/7

[58] Field of Search ..... 220/6, 7, 1.5

[56] References Cited

U.S. PATENT DOCUMENTS

| | | | |
|---|---|---|---|
| 3,130,850 | 4/1964 | Oakey | 220/6 |
| 3,223,274 | 12/1965 | Tolnai | 220/7 |
| 3,602,388 | 8/1971 | Hurkamp | 220/6 |
| 3,765,556 | 10/1973 | Baer | 220/6 |
| 3,796,342 | 3/1974 | Sanders | 220/6 |

FOREIGN PATENT DOCUMENTS

| | | | |
|---|---|---|---|
| 617571 | 2/1961 | Italy | 220/6 |
| 1007196 | 10/1965 | United Kingdom | 220/6 |

*Primary Examiner*—George E. Lowrance
*Attorney, Agent, or Firm*—Georges A. Maxwell

[57] ABSTRACT

An elongate, box-like collapsible cargo container including horizontal, vertically spaced top and bottom walls, normally vertical end walls and normally vertical sectional side walls; said end walls have frames about their perimeter, hinge means between the bottom edges of the end walls and ends of the bottom wall whereby the end walls can be selectively pivoted longitudinally inwardly and downwardly to collapsed horizontal positions atop the bottom walls; said sectional side walls include longitudinally extending upper and lower panels, hinge means between the upper and lower panels between the bottom wall and the lower panels and between the top wall and the upper panels, whereby said panels can be pivoted laterally inwardly to horizontal collapsed positions between the top wall and the end walls when said end walls are in their collapsed position; the frames of the end walls define axially inwardly opening channels along the top and side edges of the end walls and the top and side walls have axially outwardly projecting flanges engaged in the channels when the end walls are vertical.

9 Claims, 13 Drawing Figures

-20-
-15-

12
20
21
R
H
30
14
31
H'
R
20'
13
H3
P
42
45
44
26
46
22
L
42
43
40
10
15
23
24
26
25
14
H4
C
41
H3
L

CARGO CONTAINER

This invention relates to the art of cargo containers and is particularly concerned with an improved collapsible cargo container.

BACKGROUND OF THE INVENTION

In the shipping industry, the use of large cargo containers in which cargo to be shipped from one location to another is loaded. The containers are such that they can be easily and conveniently moved from one transport vehicle or vessel to another for transport across land and/or sea. The provision and use of such containers has been adopted to eliminate the necessity of manually tranferring cargo from vessel to vessel and from vehicle to vehicle in its course of being transported from one place to another and was once common practice.

The cargo containers in use today have become substantially dimensionally and structurally standardized and are such that they can be easily, conveniently and securely arranged in vertical stacked side by side and end to end relationship with each other whereby the most effective and economical use of hold and deck space on ships and the like, on which such containers are placed, is assured.

The principal shortcoming found in the use of cargo containers of the character referred to above resides in the fact that in normal use of such containers, it is not infrequent that they must be transported empty from a station or site of delivery of cargo to a next site or station for receipt or loading of cargo. Such transporting of empty containers is non-profitable since each such container occupies valuable and costly space which could otherwise accommodate a loaded or filled container. Further, the handling and shipping of both filled or loaded and empty containers creates a multitude of other problems. One such problem resides in arranging light, empty containers and heavy, loaded containers aborad ships in such a manner that the ships are properly and safely trimmed.

It is not infrequent that the majority of containers transported by a transoceanic cargo container ship are empty containers. In such instances, the voyage of such ships is uneconomical and would result in substantial financial losses if it were not for the fact that such losses are covered by increased charges exacted for the handling of and transporting of filled containers.

It has long been recognized that great economic savings in shipping by containers could be realized if empty containers could be folded or collapsed so that they occupy a small fraction of the space they occupy when in their normal configuration and so that less space need be sacrificed in the transporting of empty containers.

If two containers, when collapsed, could occupy the space of one container in its normal configuration, the cost of shipping those empty collapsed containers would be reduced about one-half. If. for example, the space occupied by such collapsible containers was one-sixth the space they nornally occupy, six empty containers would occupy the space of one full container and the cost of shipping each empty collapsed container would be about one-sixth cost of shipping an empty non-collapsible container.

The prior art has proposed a number of collapsible inter-engageable or nesting cargo container structures intended to effectively reduce the space required for their shipment when they are empty. While certain proposed collapsible containers might well serve such an end, it is understood that they are seriously wanting in certain material respects.

The first most common and serious shortcoming in most of the collapsible cargo containers that have been proposed by the prior art resides in the fact that special structural features are incorporated in them which renders them incompatible for use in combination or in conjunction with existing, standard, cargo containers. Accordingly, if such containers were to be adopted, an entirely new supply of containers and new container handling equipment would have to be provided. The costs involved in such an adoption of new containers and related equipment would be prohibitive.

Another common shortcoming found in collapsible cargo containers proposed by the prior art is the inclusion of removable or separable parts which are subject to being misplaced, lost, damaged and/or stolen. Experience has taught that if parts of equipment such as cargo containers can be removed and lost or readily damaged, such parts will be removed, lost and/or damaged in the normal course of their use and that great difficulties and inconveniences will be experienced in maintaining such containers.

Yet another shortcoming found in collapsible containers proposed by the prior art is the lack of structural features which enable or facilitate the folding down and setting up or opening of such containers in a simple and effective manner, with commonly used and available tools and equipment.

OBJECTS AND FEATURES OF THE INVENTION

An object of my invention is to provide a novel collapsible cargo container which is compatible with and such that it can be used in conjunction or in combination with existing standard non-collapsible cargo containers.

It is another object and a feature of my invention to provide a container of the character referred to which is free of separable or removable parts whereby no parts of the container are subject to being stolen, lost or misplaced.

It is an object and feature of this invention to provide a cargo container construction which does not require assembly and disassembly of the container in its normal use.

Another object and feature of the present invention is to provide a collapsible cargo container of the general character referred to above which includes flat, horizontal, rigid unitary top and bottom walls and opposite normally vertical sectional side walls with upper and lower panel sections hingedly connected together and to related edges on the top and bottom walls whereby the upper and lower panels can pivot laterally inwardly relative to the top and bottom walls to lower the top wall relative to the bottom wall to a collapsed position where the top wall, panels and bottom wall occur in close parallel relationship with each other.

Yet another object and feature of my invention is to provide a container structure of the general character referred to above which includes normally vertical end walls within the opposite end portions of the related top, bottom and side walls, to normally maintain the top, bottom and side walls in their normal positions.

It is another object of my invention to provide a container of the character referred to above wherein the end walls have lower edges hingedly connected with the bottom wall of the container whereby said end walls can pivot longitudinally inwardly and downwardly relative to the top, bottom and side walls, to collapsed positions where they are clear of said top and side walls and permit said top and side walls to shift between their normal and collapsed positions.

Still another object and feature of this invention is to provide a container of the character referred to which includes normally vertical sectional columns at the four corners of the container; the sections of which are integrally joined with related panels of the side walls and portions of the top and bottom walls and are hingedly connected with each other to allow for free movement of the sections and their related parts of the container to and from opened and collapsed positions.

Still another object and feature of the present invention is to provide a structure referred to above which includes longitudinally inwardly projecting flanges about the ends of the top and side walls and longitudinally outwardly opening channels about the top and side edges of the end walls normally slidably receiving and engaged with the flanges to releasably retain the top, side and end walls in predetermined stable interlocked relationship with each other.

It is an object and feature of the present invention to provide a structure of the character referred to above wherein the end walls have rigid frames about their perimeters which frames define said channels and which can pivotally support and carry access door panels or fixedly support and carry rigid wall panels, as desired or as circumstances require.

It is an object and feature of my invention to provide a cargo container structure of the character referred to above wherein the flat, horizontal bottom wall has upwardly projecting longitudinal rail portions along its opposite side edges to which the lower panels of the side walls are pivotally connected and between which the end walls are freely accommodated when said end walls are pivoted to their collapsed horizontal positions.

Still another object of the present invention is to provide a container structure of the character referred to wherein the top wall has downwardly projecting longitudinal rail portions at its opposite sides to which the upper edges of said side walls are pivotally connected so that when the container is in its collapsed position, a space occurs between the top and upper panels of the side walls to accommodate lifting tools, such as the tines of forklift trucks, to facilitate elevating the top wall and moving the container between its normal and collapsed positions.

The foregoing and other objects and features of my invention will be fully understood from the following detailed description of one typical preferred form and embodiment of my invention throughout which description reference is made to the accompanying drawings.

DETAILED DESCRIPTION OF THE INVENTION

Figures 1, 2, 3, 4, 5, 6, 7, 8:
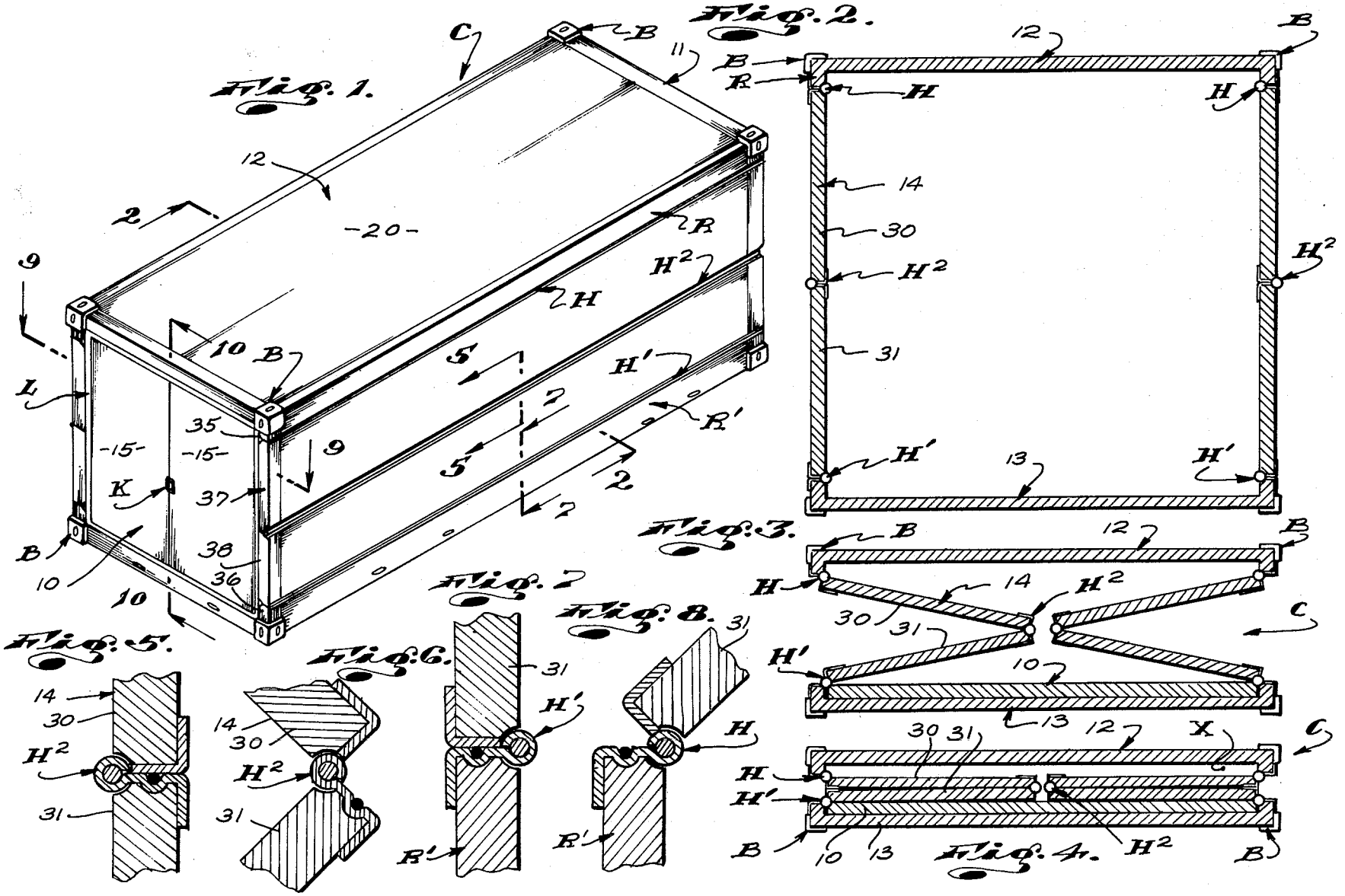
FIG. 1 is an isometric view of a cargo container embodying my invention.
FIG. 2 is a sectional view taken substantially as indicated by line 2—2 on FIG. 1.
FIG. 3 is a view similar to FIG. 2 showing the structure in a partially collapsed position.
FIG. 4 is a view similar to FIG. 2 showing the structure in a collapsed position.
FIG. 5 is an enlarged detailed sectional view taken as indicated by line 5—5 on FIG. 1.
FIG. 6 is a view similar to FIG. 5 showing parts in another position.
FIG. 7 is an enlarged detailed sectional view taken as indicated by line 7—7 on FIG. 1.
FIG. 8 is a view similar to FIG. 7 showing parts in another position.

Referring to FIG. 1 of the drawings, the cargo container C that I provide is an elongate rectilinear box like container having flat, normally vertical, substantially square front and rear end walls 10 and 11; flat, horizontal, rectangular top and bottom walls 12 and 13 and normally flat, normally vertical rectangular side walls 14.

Figures 9, 10, 13:
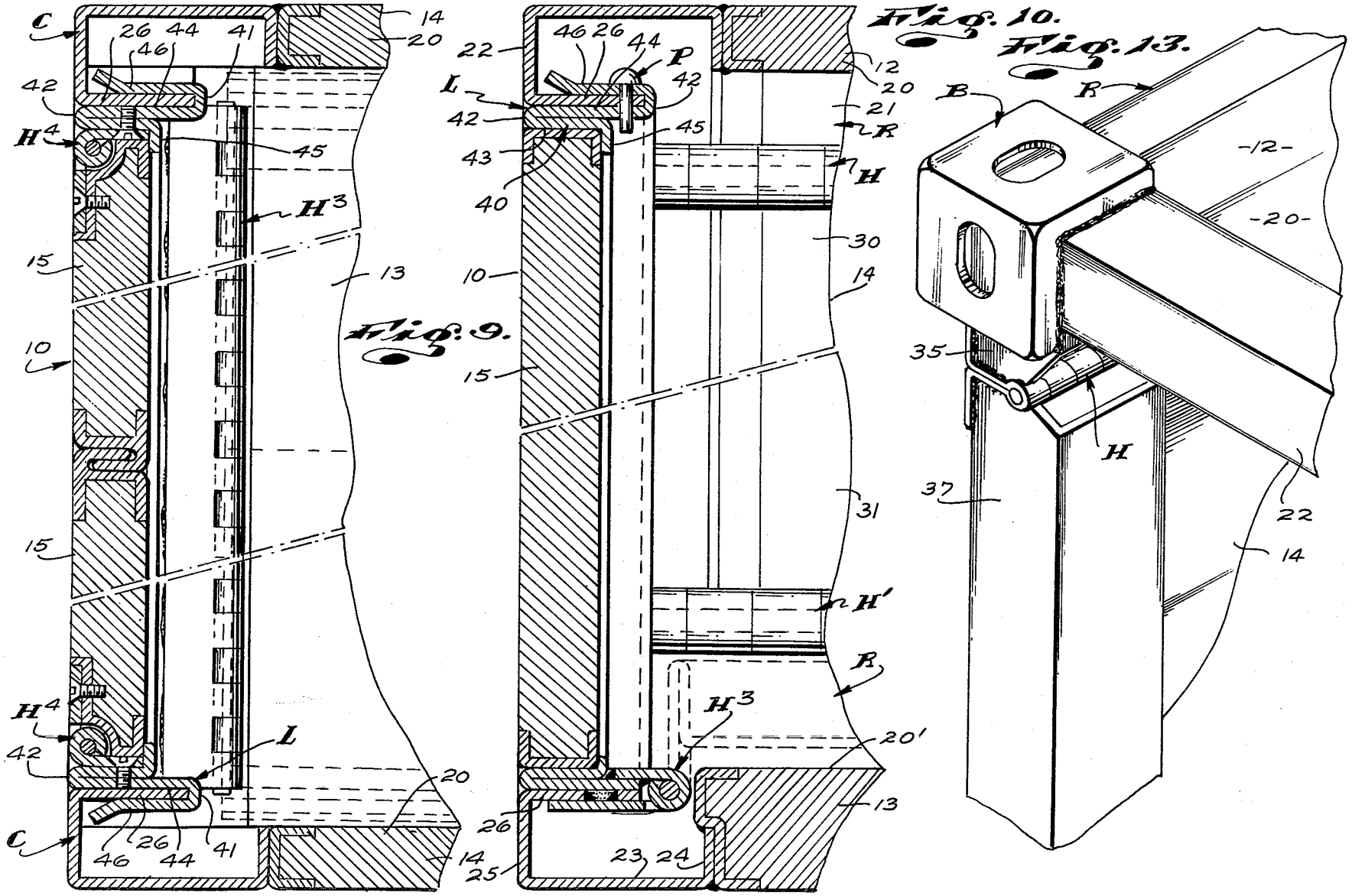
FIG. 9 is an enlarged detailed sectional view taken as indicated by line 9—9 on FIG. 1.
FIG. 10 is a sectional view taken as indicated by line 10—10 on FIG. 1.
FIG. 13 is an isometric view of the one corner of the container structure.

In practice, and as shown in FIGS. 1, 9 and 10 of the drawings, the front wall 10 is defined by a square or rectangular frame L and a pair of door panels 15 pivotally mounted within the frame L to normally close the opening defined by the frame. The rear wall 11 can be identical with the front wall 10 or can be provided with a single rigid wall panel fixed in its frame, rather than door panels such as are provided in the front wall.

The top and bottom walls 12 and 13 of the container C are essentially alike and include flat, horizontal, outer rectangular frames F and F′ and flat, rigid, horizontal panel structures 20 and 20′ fixedly mounted within the frames F and F′. In practice, the panel structure 30′ within the frame F′ of the bottom wall 13 establishes a load supporting deck and is made substantially thicker and heavier than the panel 20 of the top wall.

The frames F and F′ of the top and bottom walls 12 and 13 have straight longitudinal side stringers 21 and 21′ and straight laterally extending end beams 22 and 22′. The stringers 21 and 21′ are straight rigid box sections and are greater in vertical extent than the vertical extent or thickness of the panels 20 and 20′ and of the end beams 22 and 22′. The stringers 21 of the frame F are arranged with their top surfaces flush with the top plane of the panel 20 and with their lower portions depending from the bottom plane of the panel 20 to define laterally spaced, longitudinally extending, downwardly projecting rails R along the opposite sides of the top wall 12. The stringers 21′ of the frame F′ are like the stringers 21 of the frame F but are arranged to project upwardly relative to the bottom panel 20′ and define laterally spaced, longitudinally extending, upwardly projecting rails R′ on the bottom wall 13. The vertical extent of the rails R and R′ defined by the stringers 21 and 21′ is slightly greater than the thickness of the end walls 10 and 11 so that when the structure is collapsed and the end walls are arranged horizontally in supported engagement with the top of the bottom wall, they occur between and below the upper planes of the rails R′ and so that an access space is provided below the top wall 12 and the side walls when the structure is in its collapsed condition.

The transverse, horizontal end beams 22 and 22' of the frames F and F' are C sections formed of steel and are characterized by flat, horizontal outer walls 23 flush with the outside surfaces of the top and bottom walls 12 and 13, inner and outer vertical walls 24 and 25 and flat, straight, horizontal flanges 26 at the inner edge of the walls 25 and projecting longitudinally inwardly relative to the longitudinal axis of the container. The flange 26 of the upper beam 22 occurs on a horizontal plane below the plane of the bottom surface of the top wall 12.

The related ends of the stringers 21 and 21' and of the beams 22 and 22' are welded or otherwise fixed to related sections of vertical columns C at the four corners of the container A.

In addition to the above, the top and bottom walls include top and bottom sections 35 and 36 of normally vertical sectional columns C which occur at and define the four vertical corners of the container A. The sections 35 and 36 are similar in cross-section to the beams 22 and 22' and are fixed to the ends of the longitudinal beams 21 and 21' and to the ends of the beams 22 and 22' as by welding. The adjacent ends of the column sections 35 and 36 and their related ends of the beams 22 and 22' are preferably mitered so that the walls and flanges of the beams 22 and 22' join with corresponding walls and flanges of the column sections 35 and 36. The like walls and flanges of the column sections and beams 22 and 22' are identified by like reference numerals.

Finally, the top and bottom walls are provided with and include four like corner mounting blocks B at the four corners of those walls. The blocks B are heavy, durable, steel block-like units defining three flat load bearing surfaces which occur in outward spaced parallel relationship with the three outwardly disposed flat planes of the container defining each corner of the container. The blocks B extend about the corners established by their related column sections and beams and are fixed thereto by welding to greatly stiffen and reinforce the corner structures of the construction.

The mounting blocks B are similar in construction and design and are disposed and dimensionally arranged or positioned in the same manner as are the conventional corner mounting blocks of standard cargo containers, which are well known to those familiar with the art of cargo containers. The corner blocks B establish that means by which the container A is made compatible for use in combination with other standard cargo containers.

The sectional side walls 14 of the container A are alike. Each wall 14 includes flat normally vertical longitudinally extending upper and lower panel sections 30 and 31. The upper panel section 30 has an upper edge pivotally connected to the lower edge of the rail portion R of its related beam 21 of the top wall 12 by a hinge H. The panel 30 is hinged so that it can pivot laterally inwardly and upwardly to occur horizontally below the top wall. The lower panel 31 has a lower edge pivotally connected to the upper edge of its related rail portion R' of the beam 21' of the bottom wall 13, by a hinge H'. The panel 31 is hinged so that it can pivot laterally inwardly and downwardly to occur horizontally above the bottom wall 13, or above the end walls when said end walls are in their down or horizontal position atop the bottom wall.

The lower edge of the upper panel 30 and upper edge of the lower panel 31 are pivotally connected by a hinge $H^2$ to allow for relative pivoting of the panels when they are pivoted inwardly relative to their related top and bottom walls, as clearly shown in FIGS. 2, 3 and 4 of the drawings.

The hinges H, H' and $H^2$ are preferably elongate piano hinge structures with flange portions establishing flat stopped engagement with each other, when the construction is in its normal position, as shown in FIGS. 5 and 7 of the drawings, and are arranged so that the panels are prevented or stopped from pivoting laterally outward relative to the container structure, as is apparent from a study of FIGS. 2 through 8 of the drawings.

In addition to the foregoing, the side walls 14 include upper and lower sections 37 and 38 of the four corner columns C of the construction, which column sections are fixed to the normally vertical ends of the panels 30 and 31. The column sections 37 and 38 are normally arranged in vertically aligned, end to end, bearing engagement with each other and with their related top and bottom sections 35 and 36 (which form integrated parts of the top and bottom walls).

Figure 11:
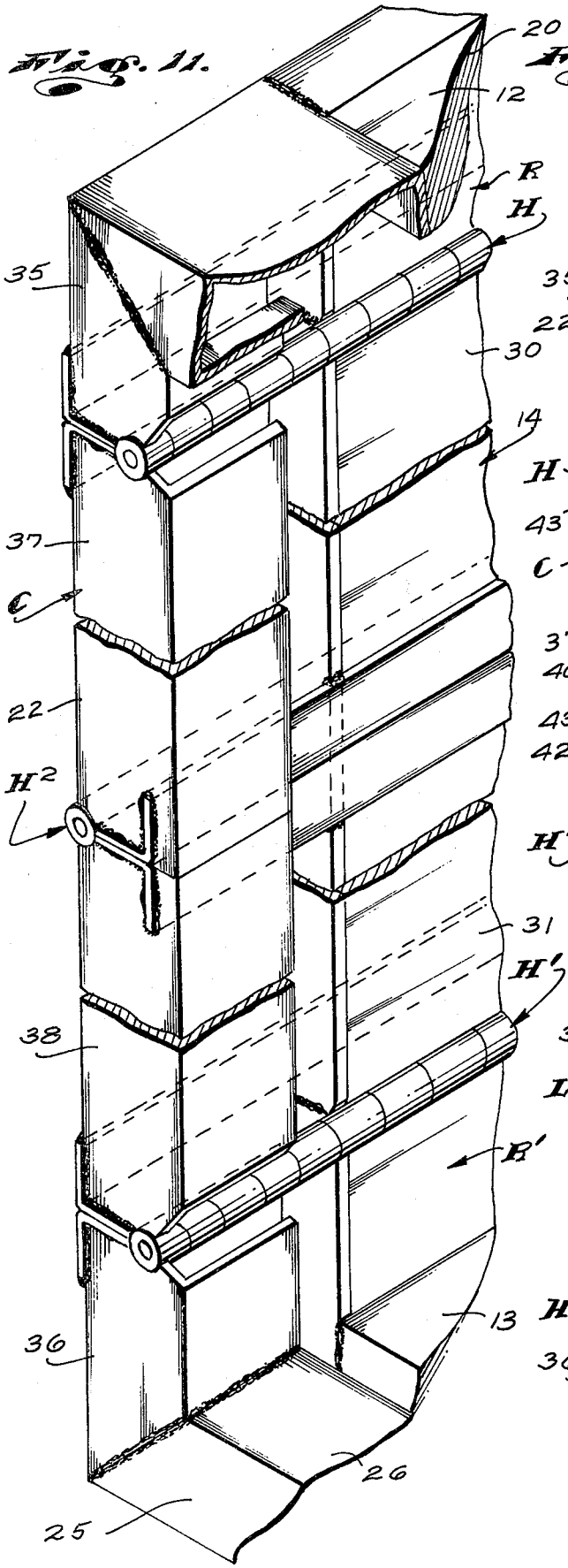
FIG. 11 is an isometric view of a portion of my new structure.

The hinges H, H' and $H^2$ of the walls 14 have extensions at their ends which continue outwardly from the panels 30 and 31 and between related opposing ends of the column sections and are fixed to the column sections as by welding. The flanges of the hinges establish load bearing and reinforcing plates at the ends of their column sections, as clearly shown in FIGS. 11 and 12 of the drawings.

With the container construction thus far described, it will be apparent that the top, bottom and side walls of the container can be folded from their normally up or open position where the sectional side walls are vertical, to down, collapsed positions where the side walls 14 are folded double and arranged horizontally between the top and bottom walls and where the vertical extent of the container is a small fraction of its normal vertical extent.

In the case illustrated, the vertical extent of the container, when collapsed, is about one-sixth the vertical extent of the container when it is in its normal or open position. It will be apparent and it is to be noted that when the container is in its normal position the longitudinally inwardly projecting flanges 26 of the upper beams 22 and of the columns C, at the opposite side of the container, occur on planes spaced inward from the inside surfaces of the top and side walls 12 and 14 and are freely accessible from the interiors of the container.

Referring again to the end walls 10 and 11, the frames L of those walls are open, square, rectangular frames formed of plate steel or the like.

Figure 12:
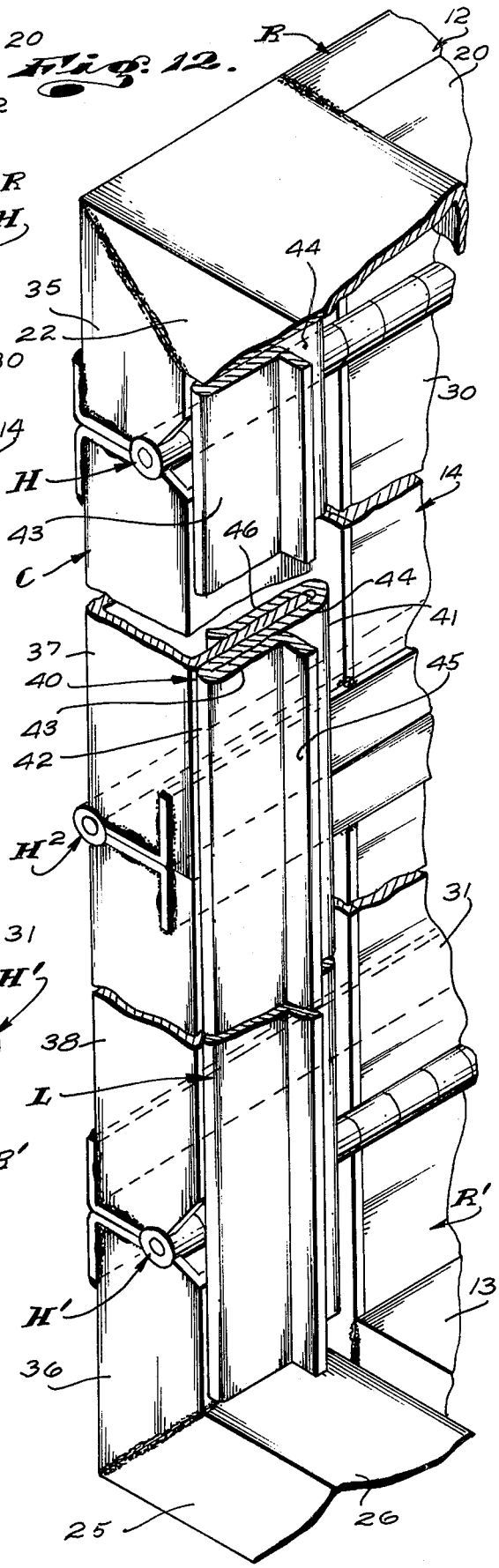
FIG. 12 is an isometric view of the structure in FIG. 11 with other structure related to it.

The frames L have straight normally vertical side members and straight horizontal top and bottom members. The side and top members are alike in cross-section. Referring to FIGS. 9, 10 and 12 of the drawings each side and top member of the frames L includes an elongate, straight, flat central portion or body 40 having normally longitudinally inwardly and outwardly disposed edges 41 and 42 and flat laterally inwardly and outwardly disposed inside and lateral outside surfaces 43 and 44; a flat stop flange 45 extending longitudinally of and projecting inwardly from the inside surface 43 and a laterally and thence longitudinally outwardly projecting lip 46 on the inner edge 41 and cooperating with the outside surface 44 to define a normally longitudinally outwardly opening channel coextensive with the members and adapted to normally slidably receive the flanges 26 of the columns C and beams 22' related thereto.

Referring to FIG. 10 of the drawings, the lower portion of the horizontal transversely extending bottom member of each frame L has a flat central portion or body 40' and a stop flange 45' similar to the bodies 40 and flanges 45 of the other members of the frames and further includes an elongate hinge $H^3$ at and extending longitudinally of or defining the rear edge of the body 40'. The hinge $H^3$ has one plate defined by or fixed to the body 40' and has its other plate integrally joined or fixed to the flange 26 of the lower rail 22', as shown in FIG. 10 of the drawing. The hinge $H^3$ is arranged so that the frame L can be pivoted longitudinally inwardly and downwardly from its normal vertical position within its related end of the container to a horizontal position, atop the bottom wall 13, out of interfering and/or supporting engagement with the top and side walls 12 and 14, as shown in FIGS. 3, 4 and 5 of the drawings and in dotted lines in FIGS. 9 and 10 of the drawings.

It is to be noted that when each frame L is in its normal vertical position, the longitudinally inwardly projecting flanges 26 of the beams 22 and of the column C related to the frame are engaged in the longitudinally outwardly or forwardly opening channels at the top and sides of the frame whereby the frame and the columns C and beams 22 are interlocked with each other. With such a relationship of parts, it will be apparent that the frames L, when in their up or normal position effectively lock the top and side walls and 14 in their normal up or open position and effectively reinforce the ends of the container structure.

Further, the several sections of the columns C (which columns are vertical load-supporting structures when the construction is in use) are normally reinforced and stopped from pivoting or moving from vertical alignment by their related side members of the frames L.

It is to be particularly noted that upon manual pivoting of the frames L, longitudinally inwardly and downwardly, the noted channels in those frames freely disengage their related flanges 26 on the top and side walls 12 and 14.

To prevent accidental or inadvertent pivoting of the frame L from their normal position, suitable releasable locking means can be provided to hold the frames L in place. As shown in FIG. 10 of the drawings, the locking means for the frames L can include simple lock pins P engaged through registering openings in the flanges 26 of the upper beams 22 and in the lips 46 and the body portion 40 of the frames L.

The above referred to door panels 15 of the front wall 10 are pivotally mounted in their related frame L of that wall by hinges $H^4$, as clearly shown in FIG. 9 of the drawings. The stops 45 on the several members of the frame L serve as door stops for the panels 15. It will be apparent that the door panels 15 can be easily and conveniently pivoted longitudinally forwardly and laterally outwardly from their normal closed position, as shown in the drawings, to open positions which afford convenient access to the interior of the container A.

In practice, suitable latch means K can be provided to maintain the door panels 15 in their normal closed position. The latch means K can vary widely in practice and can be selected from the many different door locking means provided by the prior art for releasably locking and maintaining the access doors for cargo containers and the like in closed position.

It is to be noted that the door panels 15, when in their normal position within their related frame L, reinforce and support that frame and thereby impart great strength and rigidity to the overall container structure.

The other or rear end wall 11 of the container A can be provided with hinge mounted door panels within its frame L or can be provided with a single rigid wall panel (not shown) fixedly mounted within the frame, as desired or as circumstances require. In all other respects, the rear wall 11 is the same as the front wall 10.

In practice, and in use, one end wall of the container can be manually lowered from its normal vertical position to its lower horizontal position without danger of the side walls moving inwardly and the collapsing of the container, since the other end wall, being in its normal position. Thereafter, the top wall 12 of the container can be engaged and supported in its normal or up position by means of cargo container handling means commonly provided where such containers are worked with and which generally includes jack or hoisting means with container corner mounting blocks engaging tackle and are operable to lift or elevate the containers.

Alternatively, the top wall 12 of the container A can be held up and supported by the tines of forklift trucks or the like engaged beneath that top wall, from the open end of the container.

Next, the other end wall of the container is manually or otherwise lowered from the normal to its down position, thereby releasing and conditioning the panels of the side walls 14 of the container to pivot laterally inwardly.

Thereafter, the top wall 12 of the container is lowered by means of equipment which is available and is utilized to support it. As the top wall is lowered, the side walls 14 fold inwardly toward their collapsed position, as shown in FIG. 3 of the drawings and continue to move until the container is fully collapsed, as shown in FIG. 4 of the drawings.

When the container is collapsed, it can, by means of its four corner blocks B be cooperatively engaged in stacked relationship with other like collapsed or uncollapsed containers or with conventional non-collapsible containers, as desired or as circumstances require.

The vertical extent of the container A shown in the drawings, when in its collapsed conditon, is one-sixth its normal vertical extent. Accordingly, six empty collapsed containers A, when in stacked relationship with each other, occupy the space of one, empty, non-collapsible container of like size and capacity.

When it is desired to move or operate the container A from its down or collapsed position to its up or normal position, the top wall is elevated by available cargo container handling equipment or by a forklift truck, or the like. When the top wall reaches its normal vertical position and the side walls reach their normal vertical position, one end wall is pivoted from its down to its up position and locks the top, bottom and side walls in their normal position. Thereafter, the other end wall is moved and set in its normal position and the container is ready to receive cargo and to be stacked or otherwise cooperatively related with other like or standard cargo containers.

Having described only one typical prefered form and embodiment of my invention, I do not wish to be limited to the specific details herein set forth but wish to reserve to myself any modifications and/or variations that may appear to those skilled in the art and which fall within the scope of the following claims:

Having described my invention, I claim:

1. An elongate, box-like collapsible cargo container with rectangular top, bottom and end walls and sectional side walls, each wall having inside and outside surfaces on spaced inside and outside planes; said top and bottom walls having outer rectangular load-supporting frames including laterally extending spreaders and longitudinally extending side beams and inner panel structures closing those frames; said sectional side walls including top and bottom longitudinally extending vertical rails integrally joined with their related beams of the top and bottom walls and establishing straight, flat, downwardly and upwardly disposed edges and elongate rectangular normally vertical upper and lower panels with straight, flat upper and lower edges normally establishing flat bearing engagement with their opposing edges of the side wall structures, normally vertical load supporting sectional columns at the ends of the side walls having top and bottom sections fixed to the ends of their related rails and to the beams and spreaders of their related top and bottom wall frames and intermediate upper and lower sections fixed to their related ends of their related sections; the adjacent sections of the columns have flat normally opposing ends; a first longitudinal hinge with its axis substantially coincidental with the normal outside planes of the panels and the plane of the opposing edges thereof and fixed thereto to extend longitudinally of the panel and between their related column sections, second hinges extending longitudinally of and connecting the rails with their related panels on axes substantially coincidental with the inside planes of the panels and the planes of the opposing edges of the panels and the rails and extending between the column sections related thereto; said end walls have unitary rectangular outer frames with top, bottom and side members and inner panel closures, the outer frames normally occur within the inside ends of the top, bottom and side walls with their outside planes substantially coincidental with the end planes thereof, elongate lateral hinges with axes substantially coincidental with the inside planes of the end walls and the bottom wall and securing the end walls to their related spreaders of the frame of the bottom wall, the top and side members of the end wall frames have normally longitudinally outwardly opening channels at and coextensive with their outermost edges, the column sections at the ends of the side walls and the spreaders at the ends of the top wall have elongate longitudinally inwardly projecting flanges on planes inward of the inside planes of the top and side walls and normally slidably frictionally engaged in and establishing stopped engagement at the bottoms of the channels of their related end frame members, said channels reinforce their related flange sections and bridge between and releasably lock and hold the flanges of the top, bottom, upper and lower column sections in fixed vertical alignment with each other, and lock means engageable with and between related channels and flanges to normally releasably retain the flanges in said channels; the end walls are pivotally movable longitudinally inwardly and downwardly to a horizontal collapsed position atop the bottom wall between the lower rails of the side walls, the panels of the side walls are pivotally movable laterally inwardly and downwardly to horizontal collapsed positions atop the end walls and with the top rails supporting the top wall in a down position thereabove.

2. The cargo container set forth in claim 1 which further includes corner blocks fixed to and extending about the eight corners of the container defined by the related beams, spreaders and columns and having three flat apertured sides on planes with and spaced outward from the planes of their three related outside planes of the container which converge to define each corner thereof.

3. The cargo container set forth in claim 1 wherein the first and second hinges have flat longitudinal hinge plates fixed to and coextensive with their related edges of the rails and panels and with the opposing ends of their related column sections and normally establish flat, vertical load supporting stopped engagement with each other.

4. The cargo container set forth in claim 1 wherein the vertical extent of the bottom rails of the side walls is substantially equal to the distance between the inside and outside planes of the end walls whereby the end walls are accommodated between those rails and between the bottom wall and lower panel sections when the container is collapsed, and the top rails support the top wall in spaced relationship above the upper panels when the container is collapsed and define a space with open ends beneath the top wall to accommodate means to lower and to lift the top wall and to shift the panels of the side walls between their normal and collapsed positions.

5. The cargo container set forth in claim 4 which further includes corner blocks fixed to and extending about the eight corners of the container defined by the related beams, spreaders and columns and having flat three apertured sides on planes parallel with and spaced outward from the planes of their three related outside planes of the container which converge to define each corner thereof.

6. The cargo container set forth in claim 4 wherein the first and second hinges have flat longitudinal hinge plates fixed to and coextensive with their related edges of the rails and panels and with the opposing ends of their related column sections and normally establish flat, vertical load supporting stopped engagement with each other.

7. The cargo container set forth in claim 1 wherein the top and side members of the end wall frames are elongate formed metal members with L-shaped inner panel receiving portions having flat, elongate leg portions with front and rear edges and inwardly projecting reinforcing stop flanges coextensive with their inner edges and longitudinally outwardly opening channel defining U-shaped outer portions with flat longitudinally extending inner legs in flat bearing engagement with said flat leg portions and having front edges integrally joined with the front edge of said leg portions, flat longitudinally extending outer legs in outward spaced parallel relationship with the inner legs a distance equal to the thickness of the flanges of the columns and spreaders and a reinforcing base extending between and integrally joining the rear edges of the inner and outer legs.

8. The cargo container set forth in claim 7 wherein the front edge portions of the outer flat legs of the U-shaped portions are inclined longitudinally and laterally outwardly to reinforce those legs and to guide said flanges into engagement between said inner and outer legs.

9. The cargo container set forth in claim 1 wherein the axes of the second hinges between the rails and panels of the side walls extend between their related column sections in outward spaced relationship from the flanges of the sections and the opposing ends of the column sections adjacent to those hinges are relieved at oppositely inclined angles of 45° above and below the normal horizontal plane of the hinges whereby the sections of the columns related to the rails and their related panels can pivot 90° between their normal vertical and collapsed horizontal positions.

* * * * *